US007133631B2

(12) United States Patent
Ito et al.

(10) Patent No.: US 7,133,631 B2
(45) Date of Patent: Nov. 7, 2006

(54) TRANSFER DEVICE, WITH TRANSFER PRESSURE CONTROL

(75) Inventors: Hiroshi Ito, Nagano (JP); Hiroshi Ue, Nagano (JP); Saburo Furukawa, Nagano (JP); Shigeo Fujita, Nagano (JP); Toshihiko Yamazaki, Nagano (JP); Tatsuro Osawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 10/860,395

(22) Filed: Jun. 3, 2004

(65) Prior Publication Data

US 2005/0019066 A1 Jan. 27, 2005

(30) Foreign Application Priority Data

Jun. 4, 2003 (JP) ..... P2003-159048
Jul. 22, 2003 (JP) ..... 2003-199903
Jul. 22, 2003 (JP) ..... P2003-199902

(51) Int. Cl.
*G03G 15/16* (2006.01)

(52) U.S. Cl. ..... 399/302

(58) Field of Classification Search ..... None
See application file for complete search history.

(56) References Cited

U.S. PATENT DOCUMENTS 5,534,984 A * 7/1996 Inoue ..... 399/308
6,862,421 B1 * 3/2005 Choi ..... 399/302

FOREIGN PATENT DOCUMENTS

| | | | |
|---|---|---|---|
| JP | 05301652 | A * | 11/1993 |
| JP | 06-222688 | | 8/1994 |
| JP | 06-308842 | | 11/1994 |
| JP | 08-220833 | | 8/1996 |
| JP | 10-003239 | | 1/1998 |
| JP | 10282803 | A * | 10/1998 |
| JP | 11-219030 | | 8/1999 |
| JP | 2001-048349 | | 2/2001 |
| JP | 2001-194932 | | 7/2001 |
| JP | 2001-228771 | | 8/2001 |
| JP | 2003-043886 | | 2/2003 |

* cited by examiner

*Primary Examiner*—Quana Grainger
(74) *Attorney, Agent, or Firm*—Hogan & Hartson LLP

(57) ABSTRACT

A transfer device includes a pair of transfer frames, a belt member, a pair of transfer roller levers which are respectively arranged on inner sides of the transfer frames pivotably, a transfer roller which is provided between first ends of the transfer roller levers rotatably, a pair of first urging members, which are respectively provided on second ends of the transfer roller levers to energize the transfer roller toward the belt member, and a pair of transfer pressure controlling members which are respectively provided on the transfer frames movably to control urging power of the first urging members.

2 Claims, 16 Drawing Sheets

TRANSFER DEVICE, WITH TRANSFER PRESSURE CONTROL

BACKGROUND OF THE INVENTION

The present invention relates to an image forming apparatus using electrophotography such as a copying machine, a printer or a facsimile.

Also, the present invention relates to a toner transporting device which transports waste toner removed from an image bearing member by using a metal spiral member, and an image forming apparatus having the toner transporting device.

As an image forming apparatus, there is a type in which an electrostatic latent image is formed on an image bearing member such as a photoconductor, this electrostatic latent image is developed with toner. Then, a toner image is subjected to a first transfer onto an intermediate transfer belt. By repeating the above process each time the intermediate transfer belt rotates, multi layer transfer is performed on the intermediate transfer belt, and thereafter a full color image of four colors is subjected to a second transfer on a sheet material.

In this type image forming apparatus, when the toner image on the image bearing member is subjected to the first bias transfer on the intermediate transfer belt, the toner image is transferred onto the intermediate transfer belt by a bias applied to a transfer roller. At this time, it is necessary to keep appropriate and uniform a transfer pressure for pressing the transfer roller on the image bearing member through the belt. This reason is that: if the transfer pressure is too high, a hollow defect is produced in the toner image after transfer; and if the transfer pressure is too low, poor transfer is caused. Therefore, a type in which a transfer pressure controlling unit for pressing a first bias transfer roller is provided has been known (refer to JP-A-2001-194932).

However, JP-A-2001-194932 does not disclose how to attach the transfer pressure controlling means for the transfer roller to a frame of the intermediate transfer belt. Further, since a belt retreat mechanism and a belt tension mechanism are generally provided on the frame of the intermediate transfer belt, it is difficult to provide the transfer pressure controlling unit simply.

Further, waste toner removed from an image bearing member is transported to a discharge port by a toner transporting screw arranged in a waste toner transporting path (refer to JP-A-2001-228771). The screw has two types wound spirally, of which one is made of plastic, and of which the other is made of metal. The type in which the metal is wound has the following characteristics.

Since the waste toner can be uniformly transported to the discharge port little by little, clogging of the waste toner near the discharge port is difficult to occur.

Since the metal screw is more elastic than the plastic screw, resistance is difficult to be produced from a shape of the waste toner transporting path and a surface thereof.

The metal screw having such the characteristics includes problems of an unstable posture and vibration. Therefore, until now, the metal screw rotates while its both ends are fixed thereby to prevent the problems of the unstableness and the vibration.

Conventionally, using such the characteristics, the waste toner is transported. Regarding transportation of the waste toner, it is not preferable that the waste toner remains in the transporting path. Particularly, in a case that the waste toner remains near the discharge port (on the opposite side to a screw drive side), there are the following problems.

Clogging near the discharge port due to the residual waste toner.

Stain due to flying of the waste toner in exchange of a waste toner bottle or in cleaning in a cleaner.

Further, also in case that the waste toner remains near the drive side, the following problem is thought.

Waste toner leakage from a bearing part by drive vibration.

Since the above problems are caused, it is necessary to make the clearance amount between the screw and the transporting path side surface minimum thereby to reduce the residual toner in the transporting path as much as possible.

However, in a case that the clearance amount is small, the screw may rub strongly against the side surface of the transporting path at its both ends, which causes abnormal sound. As a cause of the strong rubbing, there are the following two factors.

Off-centering of screw in a nozzle (cap part of screw extending from a cleaner case to the outside.

Slack of screw produced by friction power between the off-center screw and the transporting path side surface.

A center position of the screw is determined by a center axis in the nozzle and the bearing without allowance (play). Therefore, in a case that decentering of the screw in the nozzle is produced by rotation of the screw, the pressure generated by the decentering is applied onto the transporting path side surface and the screw rubs against the transporting path side surface, so that the abnormal sound is generated. Further, the slack of the screw is caused by decentering, whereby the screw rubs against the transporting path side surface, so that the abnormal sound is generated. Since the screw is essentially decentered, in a case that the metal screw is used, it is necessary to take some measures for the factors of decentering.

Further, in an intermediate transfer system of an electrophotographic process, a toner image formed on a photoconductor is multi-layer transferred on an intermediate transfer medium (first bias transfer). A belt supported by plural roller or an intermediate transfer drum is used as the intermediate transfer medium. After transfer (second bias transfer) is performed from the intermediate transfer medium onto a transfer material, toner (residual toner) which is not transferred completely remains on the intermediate transfer medium. In a case that the transfer material is jammed because of any reason, a large amount of the toner remains on the intermediate transfer medium. In order to remove this residual toner, generally a blade or a brush is brought into contact with the intermediate transfer medium to scrape off the toner. The scraped-off toner is fed to a waste toner tank for storing the waste toner by a spiral rotator for transporting the waste toner which is located under the blade or the brush (JP-A-2001-228771).

However, in the constitution of the related example, under the blade or the brush, or at the inside of a cleaner which is a transporting path of the waste toner, the waste toner that has not been completely removed by only rotation of the spiral rotator remains. When the apparatus is violently moved in carriage under a state where the waste toner remains, the residual toner inside the cleaner flies up, so that the toner scatters inside the apparatus. This scattering is produced more severely by collision in the toner transporting path between the spiral rotator and the transporting path due to the vibration. In order to prevent this scattering, the blade or the brush comes into contact with the intermediate transfer medium when the apparatus stops, whereby the toner leakage can be prevented. However, in this case, the blade or the brush causes permanent strain, so that there is a problem that cleaning performance worsens. Further, when the severe vibration is forecasted, the intermediate transfer medium and the cleaner part may be detached from the apparatus body to perform cleaning. However, in this case, the operation becomes troublesome, so that there are also problems that cleaning cannot be performed sufficiently, the unit is broken with the detachment, and the intermediate transfer medium surface is stained by contact.

SUMMARY OF THE INVENTION

It is therefore an object of the present invention to provide a transfer unit which can control transfer pressure in order to apply the appropriate and uniform transfer pressure to the transfer roller.

In order to achieve the above object, according to the present invention, there is provided a transfer device, comprising:

a pair of transfer frames;

a belt member;

a pair of transfer roller levers, which are respectively arranged on inner sides of the transfer frames pivotably;

a transfer roller, which is provided between first ends of the transfer roller levers rotatably;

a pair of first urging members, which are respectively provided on second ends of the transfer roller levers to energize the transfer roller toward the belt member; and a pair of transfer pressure controlling members, which are respectively provided on the transfer frames movably to control urging power of the first urging members.

Preferably, the transfer device further comprising:

a pair of support roller levers, which are respectively provided on the transfer frames pivotably;

a support roller, which is provided between first ends of the support roller levers, and arranged on an upstream of the transfer roller in a transporting direction of the belt member;

a pair of second urging members, which are respectively provided on the second ends of the support roller levers to energize the support roller levers in a direction in which the support roller separates from the belt member; and a pair of cam members, which are respectively provided on the transfer frames rotatably, wherein the cam members rotates at three positions;

wherein the support roller levers are energized toward the belt member in a first position of the cam members;

wherein the support roller levers are energized toward the transfer roller levers so that both the transfer roller and the support roller are separated from the belt member in a second position of the cam members; and wherein the transfer roller levers are fitted to the transfer frames so that both the transfer roller and the support roller are further separated from the belt member in a third position of the cam members.

Preferably, tension of the belt member is loosed in the third position.

In the above configurations, in order to apply the transfer pressure appropriately and uniformly to the transfer roller, the transfer pressure can be controlled. Further, the controlling member can be provided readily using a retreat mechanism of the transfer device. Further, by providing a delivery position (third position) for the retreat mechanism, durability of the belt can be improved.

Further, in order to solve the above problems, it is therefore an object of the present invention to provide a waste toner transporting unit which prevents generation of abnormal sound due to decentering of the screw, and generation of abnormal sound due to the slack caused by the frictional power produced by decentering of the screw.

In order to achieve the above object, according to the present invention, there is provided a waste toner transporting device, comprising:

a waste toner container, which has a waste toner discharge port;

a screw, which is provided in the waste toner container, and transports waste toner to the waste toner discharge port;

a screw attachment shaft, which is attached to the screw, and arranged near the waste toner discharge port; and a screw bearing, which supports a supporting portion of the screw attachment shaft with gap so as to absorb an increase of pressure of the screw in a diameter direction perpendicular to an extension direction of the screw produced by decentering of the screw.

Preferably, the screw attachment shaft moves in the diameter direction by the gap between the supporting portion and an inner face of the screw bearing.

Further, a waste toner transporting device, comprising:

a waste toner container;

a screw, which is provided in the waste toner container, and transports waste toner; and a screw coupling member, which is coupled to a coupling portion of the screw with gap, and the screw coupling member arranged near a screw driving member, wherein the gap between the screw coupling member and the coupling portion is exist in a first direction in which the screw extends and a second direction perpendicular to the first direction; and wherein slack of the screw in the first and second directions caused by frictional power due to decentering of the screw is absorbed.

Further, an image forming apparatus of the invention is provided with the above waste toner transporting device.

In the above configurations, the gap is given to the inner diameter of the bearing in a nozzle, whereby a relief of the pressure in the diameter direction generated by decentering of the screw is provided, so that the pressure on a side surface of a transporting path can be reduced. Further, the screw is fixed in the coupling form, and the gap is provided in an axial direction and in a diameter direction of the screw, whereby the slack generated by the friction power is absorbed in the axial direction. In result, the contact pressure on the waste toner transporting path side surface due to decentering of the screw becomes small, and the slack can be also absorbed in the axial direction and in the diameter direction by the coupling form, so that the abnormal sound can be eliminated.

Further, in order to solve the above problems, an object of the invention is to remove the residual toner inside the cleaner without detaching the intermediate transfer medium and the cleaner part from the apparatus body.

In order to achieve the above object, according to the present invention, there is provided a waste toner transporting device, comprising:

a waste toner container, which contains waste toner, wherein a cleaning hole for cleaning inside of the waste toner container is formed on a wall face of the waste toner container.

Preferably, the waste toner transporting device, further comprising:

a plug member, which is attached to the cleaning hole, wherein the plug member has a waste toner discharge port; and wherein the plug member is coupled to a waste toner transporting member for transporting the waste toner to the waste toner discharge port.

Preferably, the waste toner transporting member extends from an inside of the waste toner container through the cleaning hole to an outside of the waste toner container. The plug member is a cap which covers a part of the waste toner transporting member which extends to the outside of the waste toner container.

Preferably, the plug member is detachably attached to the waste toner transporting member.

Preferably, the waste toner transporting member is detachably coupled to a drive member on the opposite side to a plug member side. The waste toner transporting member is pulled out of the waste toner container from a plug member side in a state that the toner transporting member is uncoupled from the drive member.

Preferably, the waste toner transporting member is coupled to a drive member in a plug member side. An opposite side of the waste toner transporting member to the plug member side is a free end. The waste toner transporting member is pulled out of the waste toner container from the plug member side.

In the above configurations, without detaching an intermediate transfer medium and the waste toner container from an apparatus body of an image forming apparatus, the waste toner inside the waste toner container can be removed, so that when the image forming apparatus is carried, it is prevented that the toner scatters inside and outside the apparatus. Further, since the plug member to which the toner transporting member is coupled, and the toner transporting member itself can be detached, cleaning inside the cleaner becomes more easy, so that the waste toner can be reduced as much as possible.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
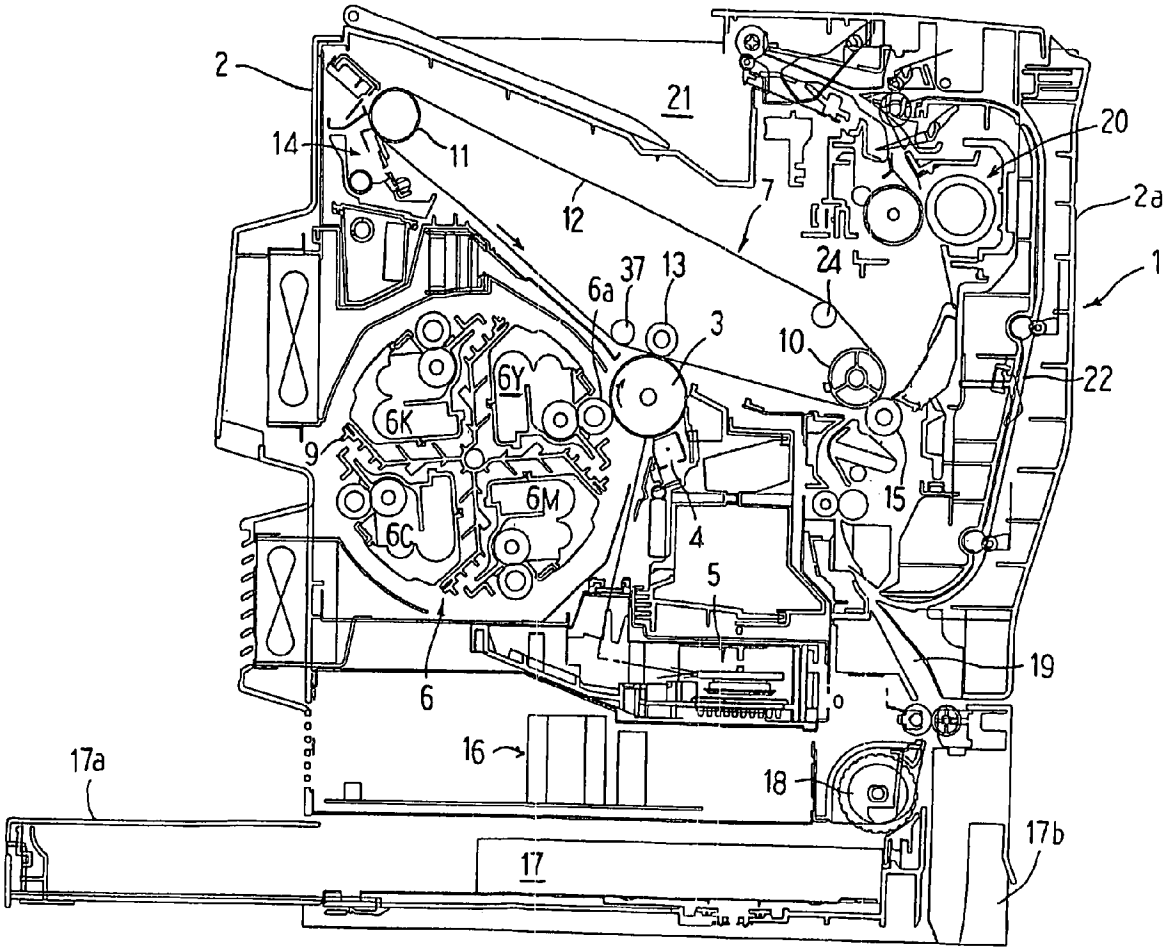
FIG. 1 is a whole constitutional view showing an image forming apparatus according to a first embodiment of the invention.

With reference to drawings, embodiments of the invention will be described below. FIG. 1 is a whole constitutional view showing an image forming apparatus according to a first embodiment of the invention.

An image forming apparatus 1 has a body case 2 and a front cover 2*a*. The front cover 2*a* is attached to a front surface of the apparatus 1 openably and closeably. In the body case 2, an image bearing member 3 composed of a photoconductor drum is arranged, and rotated by a drive device (not shown) in a direction of an arrow. A charge unit 4 for uniformly charging the image bearing member 3, an exposing unit 5 for forming an electrostatic latent image on the image bearing member 3, a rotary developing unit 6 for developing the electrostatic latent image, and a transfer unit 7 for subjecting a toner image of a single color to first bias transfer are arranged around the image bearing member 3 in its rotational direction.

In the rotary developing unit 6, a yellow developing unit 6Y, a magenta developing unit 6M, a cyan developing unit 6C and a black developing unit 6K are attached to a support frame 9, and the support frame 9 is rotated by a drive motor (not shown). These plural developing units 6Y, 6M, 6C, and 6K are rotated so that a developing roller 6*a* in any one of these developing units is selectively opposed to the image bearing member 3 each time the image bearing member 3 rotates by the predetermined amount. In each developing unit 6Y, 6M, 6C, 6K, a toner housing section in which toner of each color is housed is formed.

The transfer unit 7 includes a drive roller 10; a driven roller 11; a tension roller 24; an intermediate transfer belt 12 laid on each roller 10, 11, 24, and driven in a direction of an arrow; a first bias transfer roller 13 arranged on a rear surface of the transfer belt 12, opposed to the image bearing member 3; a support roller 37 provided on the upstream side in a belt transporting direction of the first bias transfer roller 13; a transfer belt cleaner 14 for removing residual toner on the belt 12; and a second bias transfer roller 15 which is arranged, opposed to the drive roller 10, and transfers a full color image of four colors formed on the intermediate transfer belt 12 onto a sheet material (paper).

Below the exposing unit 5, a power unit 16 is arranged. Further, at the bottom of the body case 2, a paper supply cassette 17 is arranged, and the sheet material in the paper supply cassette 17 is transported to a discharge tray 21 through a pick up roller 18, a sheet material transporting path 19, the second bias transfer roller 15, and a fixing unit 20. Further, the paper supply cassette 17 is attached so that it can be pulled out forward of the apparatus with a grip 17*b*, and an auxiliary cassette 17*a* which can protrude backward of the apparatus so as to meet large size paper is attached to the sheet supply cassette 17 so that it can be pulled out.

The operation of the above constructed image forming apparatus will be described. Upon reception of an image forming signal from a computer (not shown), the image bearing member 3, the development roller 6*a* of the developing unit 6, and the intermediate transfer belt 12 are driven and rotated. Firstly, the peripheral surface of the image bearing member 3 is charged uniformly by the charging unit 4, on the peripheral surface of the image bearing member 3 charged uniformly, selective exposure according to image data of a first color (for example, yellow) is performed by the exposing unit 5, and thereafter a yellow electrostatic latent image is formed.

To the position where the latent image has been formed on the image bearing member 3, the yellow developing unit 6Y rotates and its development roller 6*a* comes into contact with the image bearing member 3 in its position. Hereby, a toner image of the yellow electrostatic latent image is formed on the image bearing member 3, and next the toner image formed on the image bearing member 3 is transferred onto the intermediate transfer belt 12 by the first bias transfer roller 13. At this time, the second bias transfer roller 15 is separated from the intermediate transfer belt 12.

Correspondingly to the second color data, the third color data and the fourth color data of the image forming signals, the above processing comprising the latent image formation, the development and the transfer is repeated by rotation of the image bearing member 3 and the intermediate transfer belt 12, and the toner images of four colors according to the contents of the image forming signal are multi-layer transferred on the intermediate transfer belt 12. At a timing when this full color image reaches the second bias transfer roller 15, the sheet material is supplied from the transporting path 19 to the second bias transfer roller 15. Then, the second bias transfer roller 15 is pressed on the intermediate transfer belt 12 and a second transfer bias is applied to the second bias transfer roller 15, so that the full color toner image on the intermediate transfer belt 12 is transferred onto the sheet material. This toner image transferred onto the sheet material is heated, pressurized and fixed by the fixing unit 20. The residual toner on the intermediate transfer belt 12 is removed by the transfer belt cleaner 14.

In case of two-sided print, the sheet material that has come from the fixing unit 20 is switched back so that its rear end becomes a leading end, and supplied through a two sided print transporting path 22 to the second bias transfer roller 15 again; and the full color toner image on the intermediate transfer belt 12 is transferred onto the sheet material, and heat-pressurized by the fixing unit 20 again thereby to be fixed.

Figure 2:
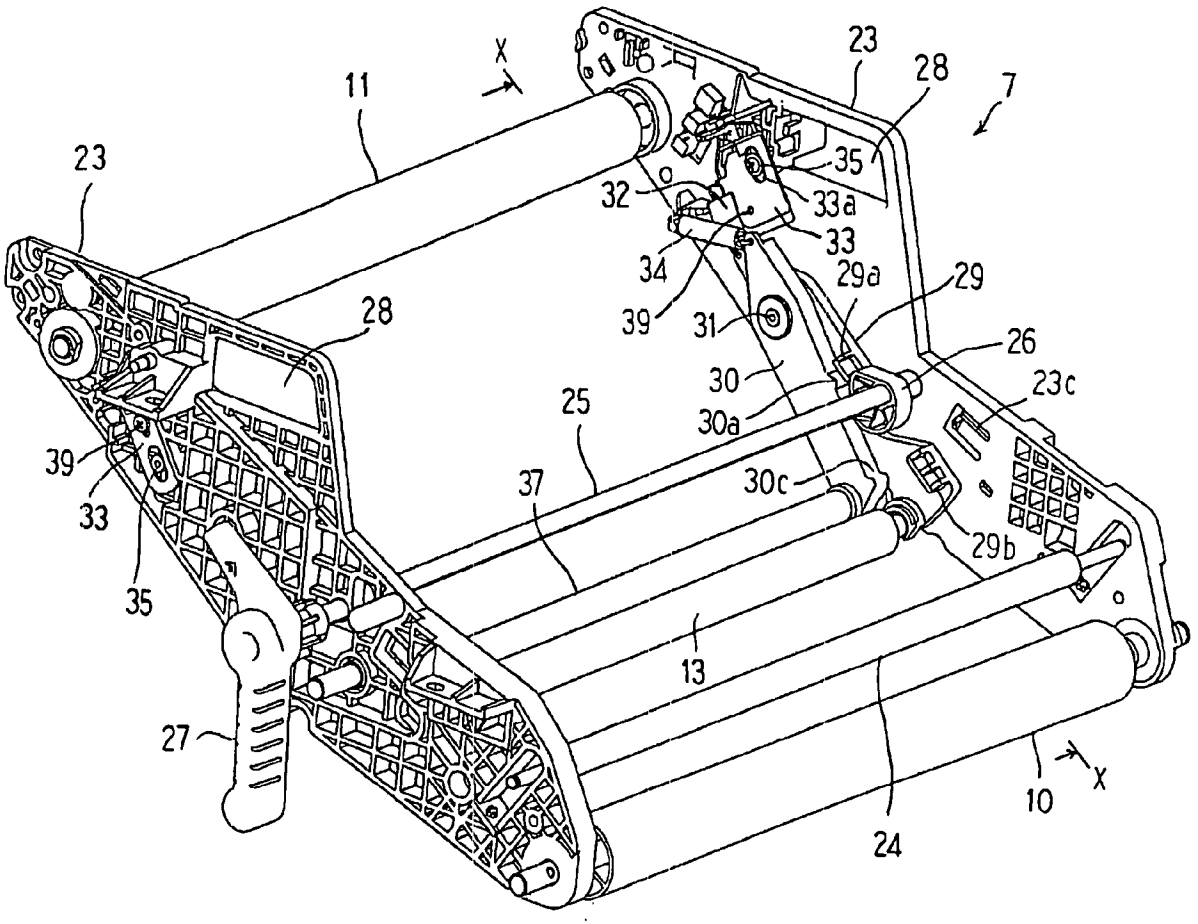
FIG. 2 is a perspective view showing the whole constitution of a transfer unit according to the invention.
Figure 3:
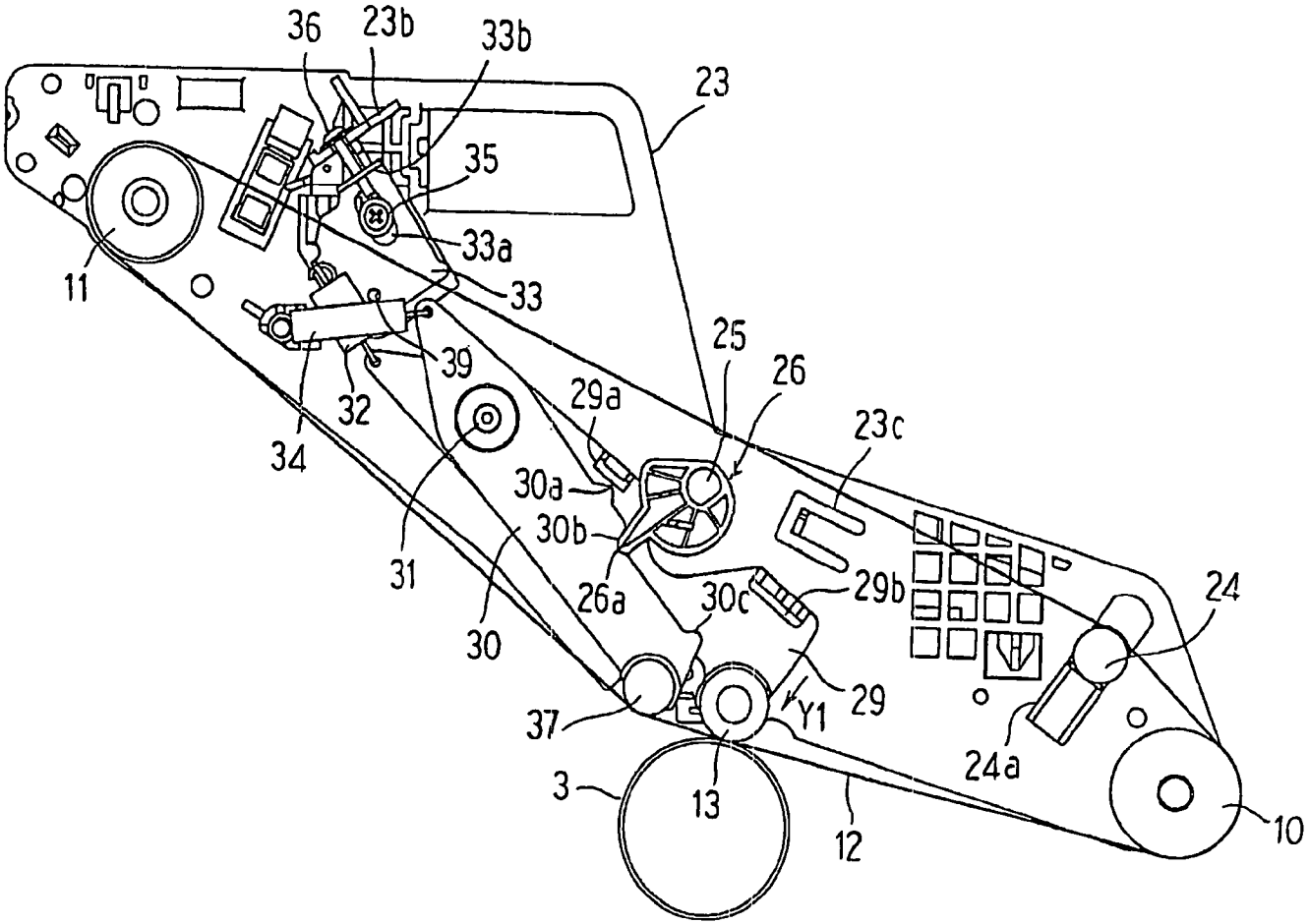
FIG. 3 is a sectional view taken along a line III—III of FIG. 2, which is viewed in a direction of an arrow.
Figure 7A:
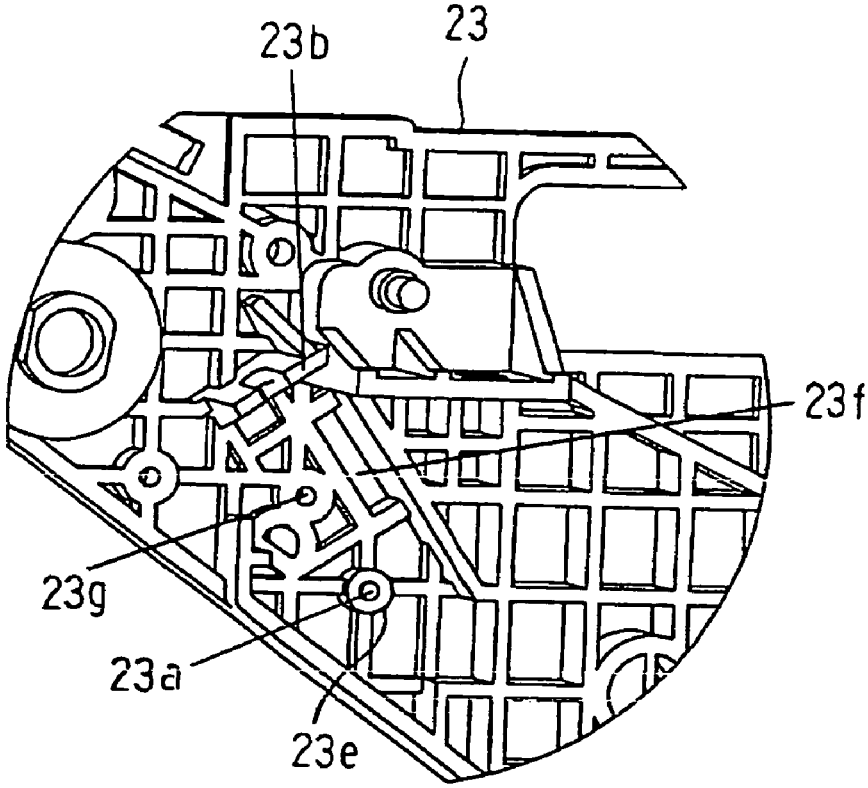
FIGS. 7A and 7B are diagrams for explaining the attachment structure of the adjustment bracket.
Figure 7B:
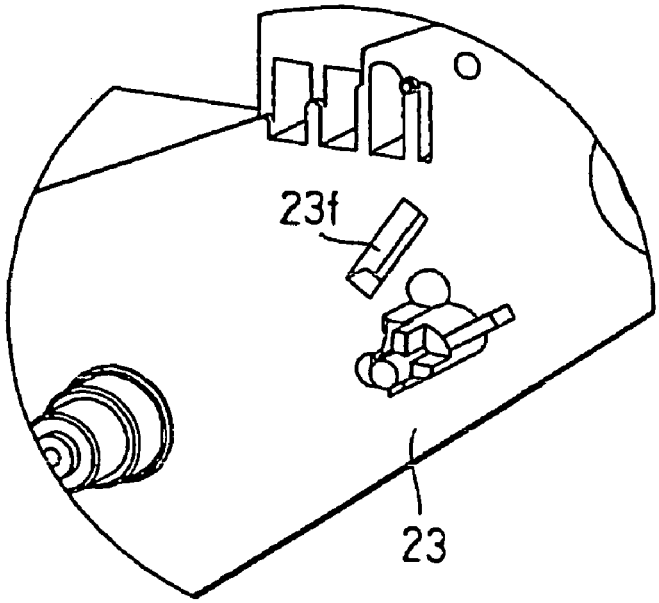
Figure 8:
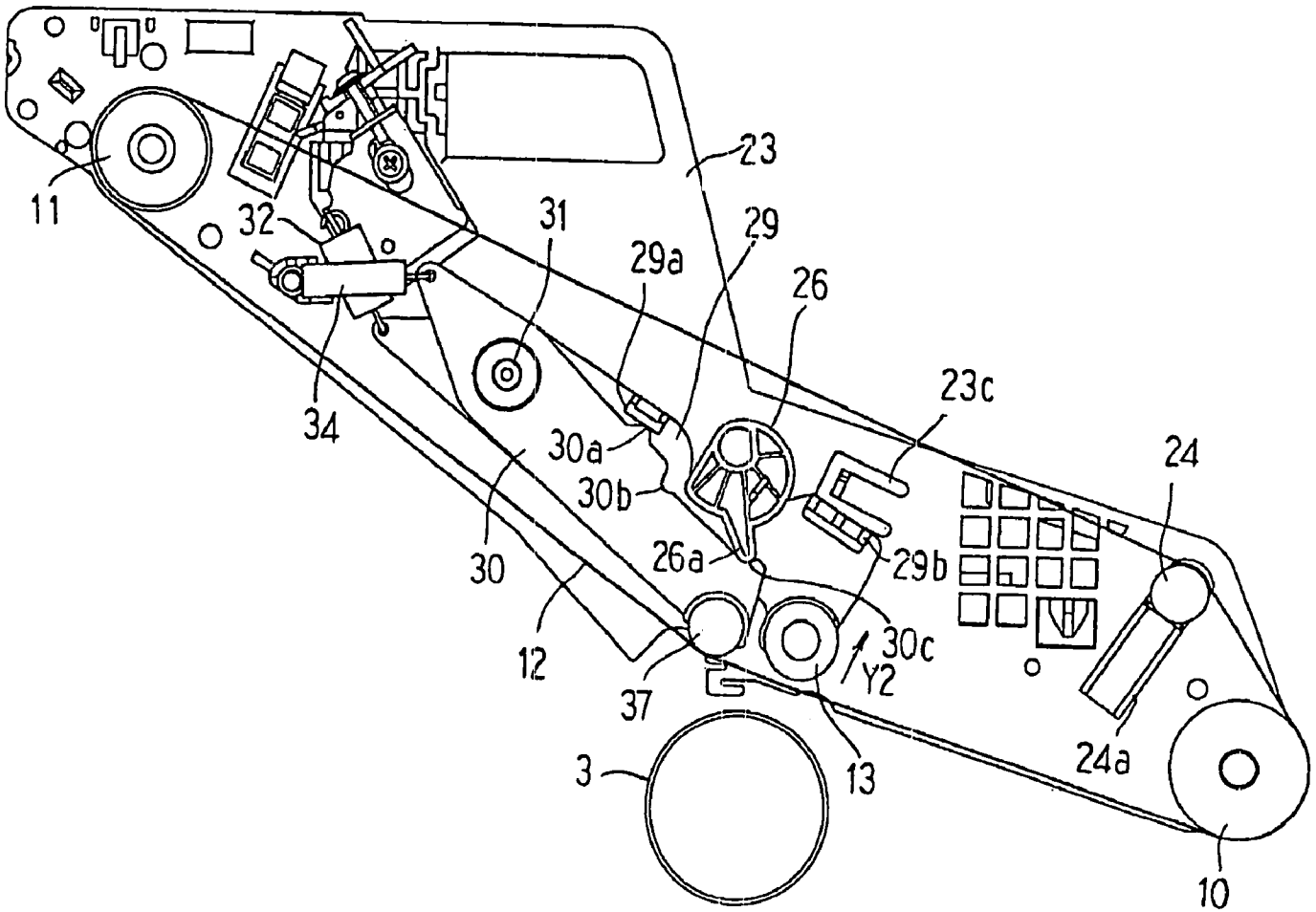
FIG. 8 is a sectional view showing a position where an image bearing member is detached.
Figure 9:
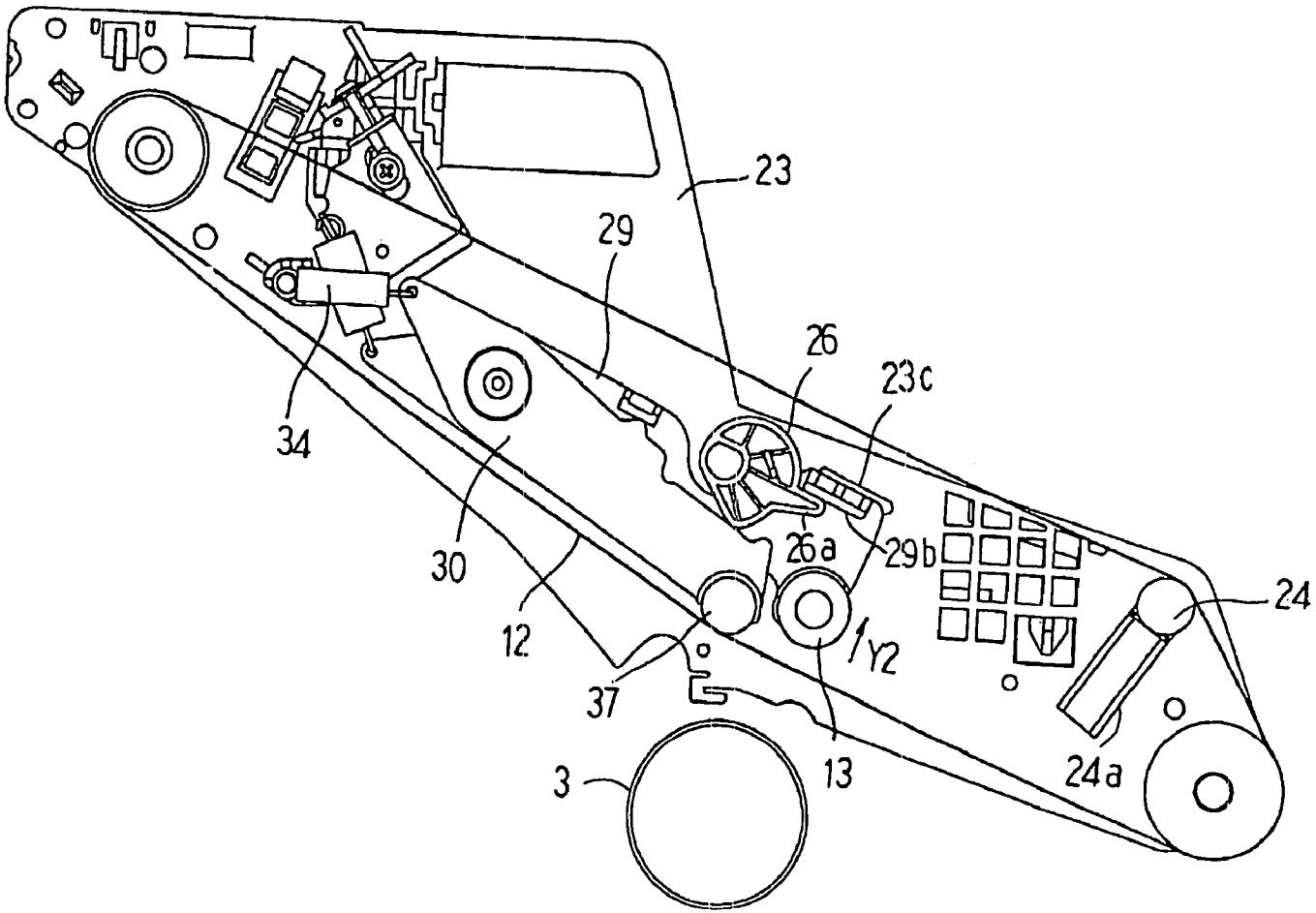
FIG. 9 is a sectional view showing a carriage position of the transfer unit.

Next, the transfer unit will be described. FIGS. 2 to 9 show the transfer unit according to the first embodiment of the invention, FIG. 2 is a perspective view showing the whole constitution of the transfer unit 7 of FIG. 1, FIG. 3 is a sectional view taken along a line III—III of FIG. 2, which is viewed in a direction of an arrow, FIGS. 4 to 7 are diagrams for explaining attachment structure of an adjustment bracket, FIG. 8 is a sectional view showing a state when the image bearing member is detached, and FIG. 9 is a sectional view showing a state when the transfer unit is carried. In each figure, the same components are denoted by the same reference numerals, and their description may be omitted.

In FIGS. 2 and 3, the transfer unit 7 has a pair of left and right transfer frames 23. The drive roller 10, the driven roller 11, the tension roller 24, and a cam shaft 25 are attached rotatably between the left and right transfer frames 23. Springs 24*a* are arranged at both ends of the tension roller 24, and energize the transfer belt 12 in a tensing direction. Cam member 26 is fixed on both sides of the camshaft 25. An operation lever 27 is fixed to the camshaft 25 on the outside of one transfer frame 23. Reference numeral 28 is a grip used for carrying the transfer unit 7.

On an inner side surface of each of the left and right transfer frames 23, a transfer roller lever 29 and a support roller lever 30 are arranged rotatably about a common support shaft 31. To one end of the transfer roller lever 29, the transfer roller 13 is attached rotatably; and at the other end thereof, a spring 32 for energizing the transfer roller 13 toward the transfer belt 12 is provided. In order to control spring power of the spring 32, the other end of the spring 32 is coupled to an adjustment bracket 33 attached to the transfer frame 23 movably. By this constitution, the transfer roller 13 of the transfer roller lever 29 is energized in a direction of an arrow Y1, whereby transfer pressure onto the image bearing member 3 is given to the transfer roller 13 and the transfer belt 12.

Further, the support roller 37 is attached to one end of the support roller lever 30 rotatably. The other end of the support roller lever 30 is fixed through a spring 34 to the transfer frame 23. Hereby, the support roller 37 side of the support roller lever 30 is rotated in the opposite direction to the Y1-direction. The transfer roller lever 29, the support roller lever 30, the springs 32 and 34, the adjustment bracket 33 are provided on each of the both transfer frames 23.

An eccentric projection-shaped cam part 26*a* is formed on the peripheral surface of the cam member 26. Further, a fitting part 30*a*, a first concave cam fitting part 30*b* and a second cam fitting part 30*c* are formed on the upper surface of the support roller lever 30. The fitting part 30*a* protrudes toward the transfer roller 13. The first concave cam fitting part 30*b* is located in a lower position than the position of this fitting part 30*a*. The second cam fitting part 30*c* is located in a lower position than the position of the first cam fitting part 30*b*. Further, a fitting piece 29*a* fittable to the fitting part 30*a*, and a fitting piece 29*b* fittable to a fitting piece 23*c* formed on a side surface of the transfer frame 23 are formed at the upper end on a side surface of the transfer roller lever 29.

Figure 4A:
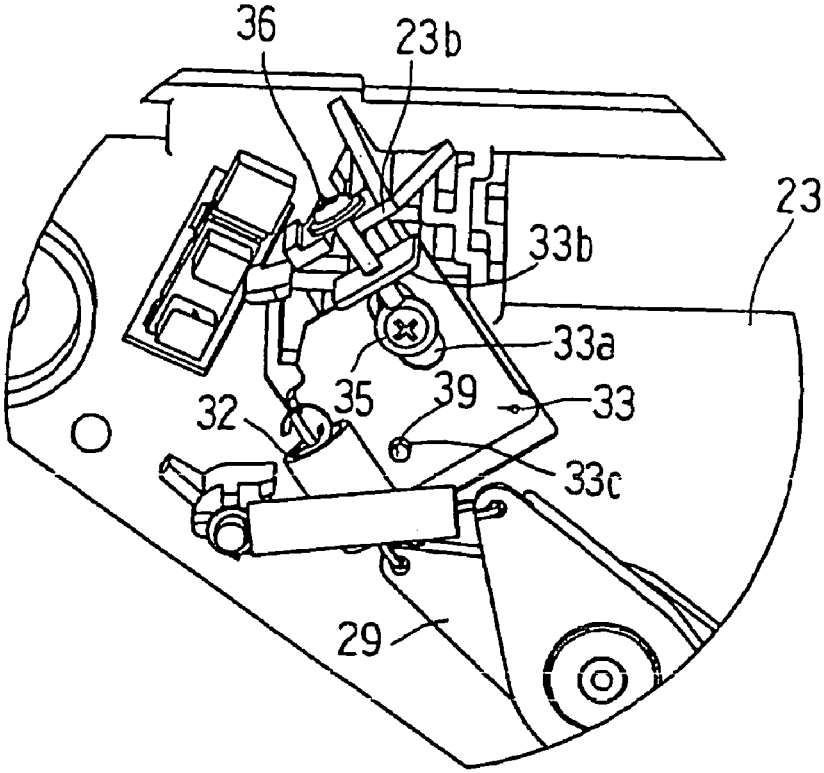
FIGS. 4A and 4B are diagrams for explaining attachment structure of an adjustment bracket.
Figure 4B:
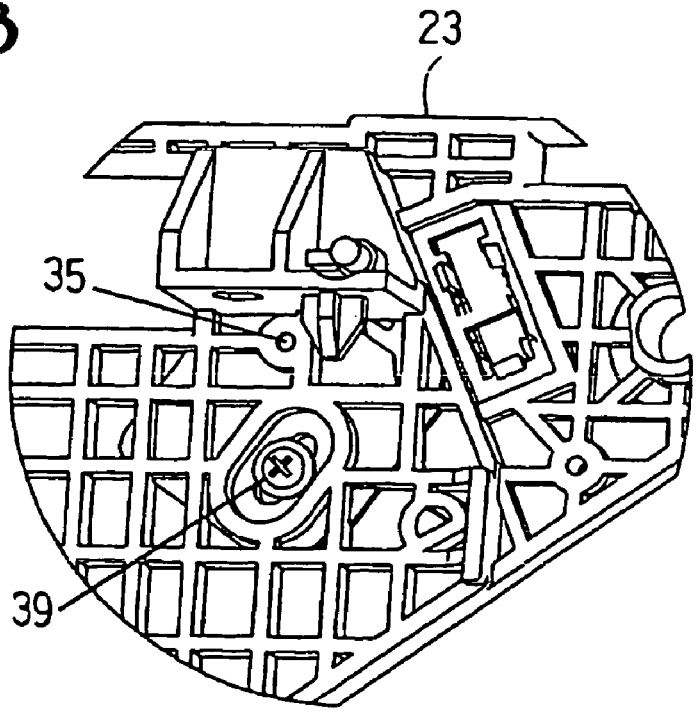
Figure 5A:
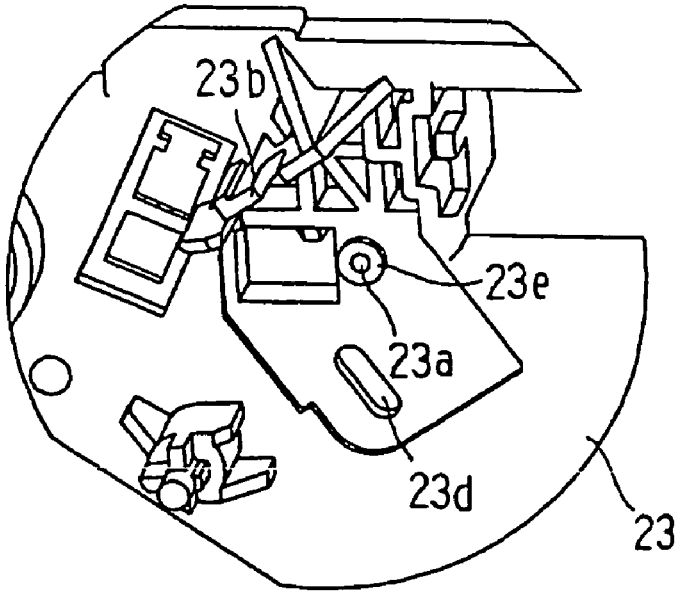
FIGS. 5A and 5B are diagrams for explaining the attachment structure of the adjustment bracket.
Figure 5B:
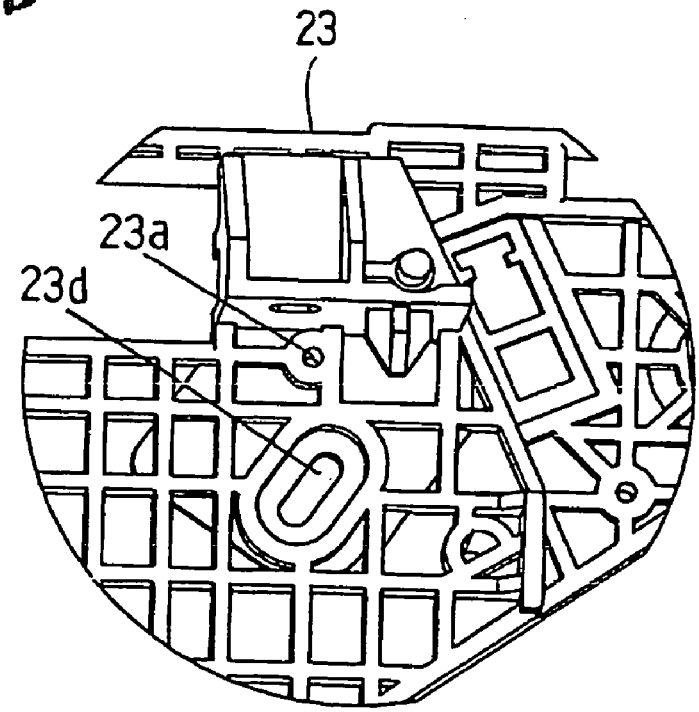

Next, the attachment structure of the adjustment bracket 33 will be described. FIGS. 4A and 4B show a part of the right transfer frame 23 in FIG. 2 in a state that the adjustment bracket 33 is attached, and FIGS. 5A and 5B show the part of the right transfer frame 23 in FIG. 2 in a state that the adjustment bracket 33 is detached. Further, FIGS. 4A and 5A are diagrams of the transfer frame 23 viewed from the inside, and FIGS. 4B and 5B are diagrams of the transfer frame 23 viewed from the outside.

Firstly, the right transfer frame 23 will be described. As shown in FIGS. 2 to 4A, a long hole 33*a* is formed in the adjustment bracket 33, a standing piece 33*b* is formed at the upper end of the adjustment bracket 33, and a screw hole 33*c* is formed. On the other hand, also on the transfer frame 23 side, a standing piece 23*b* is provided, and an adjustment screw 36 is inserted between the both standing pieces 23*b* and 33*b* and tightened. Further, on the transfer frame 23 side, as shown in FIGS. 5A and 5B, a screw hole 23*a* is formed opposed to the long hole 33*a*, and a long hole 23*d* is formed opposed to the screw hole 33*c*. Further, in the inner periphery of the transfer frame 23 of the screw hole 23*a*, a boss 23*e* that is slightly thicker than the adjustment bracket 33 is projectingly provided. When a first fixing screw 35 is inserted between the long hole 33*a* and the screw hole 23*a* from the adjustment bracket 33 side and tightened, the adjustment bracket 33 can slide and is held in a state where the adjustment bracket 33 does not drop. Further, a second fixing screw 39 is inserted between the long hole 23*d* and the screw hole 33*c* from the outside of the transfer frame 23 and tightened, whereby the adjustment bracket 33 can be fixed to the transfer frame 23.

Figure 6A:
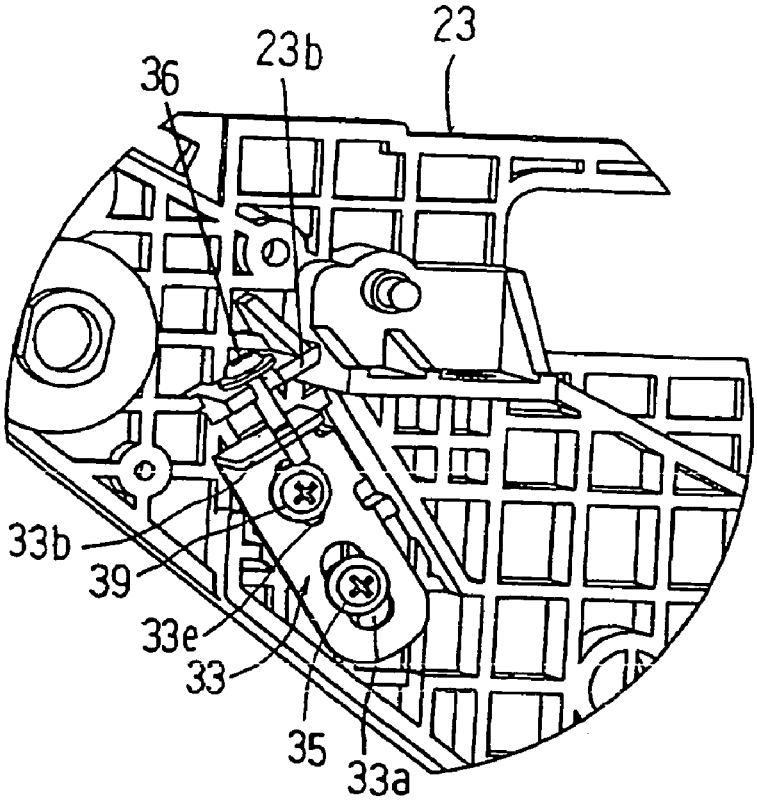
FIG. 6 is a diagram for explaining the attachment structure of the adjustment bracket.
Figure 6B:
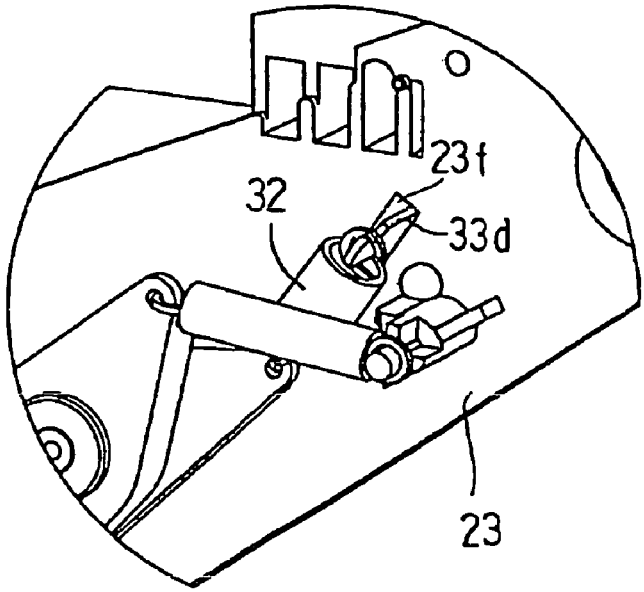

Next, the left transfer frame 23 will be described. FIGS. 6A, 6B, 7A and 7B show a part of the left transfer frame 23 in FIG. 2, in which FIGS. 6A and 6B show states where the adjustment bracket 33 is attached, and FIGS. 7A and 7B show states where the adjustment bracket 33 is detached. Further, FIGS. 6A and 7A are diagrams of the transfer frame 23 viewed from the outside, and FIGS. 6B and 7B are diagrams of the transfer frame 23 viewed from the inside.

The left transfer frame 23 is different from the right transfer frame 23 in that an adjustment bracket 33 is attached on the outside of the transfer frame 23, and a spring support part 33*d* of the adjustment bracket 33 is protruded from an opening 23*f* provided in the transfer frame 23 and coupled to the spring 32. As shown in FIG. 6, long holes 33*a* and 33*e* are formed in the adjustment bracket 33, and a standing piece 33*b* is formed at the upper end of the adjustment bracket 33. On the other hand, also on the transfer frame 23 side, a standing piece 23*b* is provided, and an adjustment screw 36 is inserted between the both standing pieces 23*b* and 33*b* and tightened. Further, on the transfer frame 23 side, as shown in FIGS. 7A and 7B, a screw hole 23*a* is formed opposed to the long hole 33*a*, and a screw hole 23*g* is formed opposed to the long hole 33*e*. Further, in the periphery of the screw hole 23*a*, a boss 23*e* that is slightly thicker than the adjustment bracket 33 is projectingly provided. When a first fixing screw 35 is inserted between the long hole 33*a* and the screw hole 23*a* from the adjustment bracket 33 side and tightened, the adjustment bracket 33 can slide and is held in a state where the adjustment bracket 33 does not drop. Further, a second fixing screw 39 is inserted between the long hole 33*e* and the screw hole 23*g* from the outside of the transfer frame 23 and tightened, whereby the adjustment bracket 33 can be fixed to the transfer frame 23.

In a case that the transfer pressure is controlled, the second fixing screw 39 is loosened and the adjustment screw 36 is turned thereby to move the adjustment bracket 33 along the boss 23*e*. Then, the adjustment bracket 33 is fixed again by the second fixing screw 39, whereby the energizing power in the Y1-direction on the transfer roller 13 side of the transfer roller lever 29 can be adjusted. In the above embodiment, though the different adjustment brackets 33 are attached on the left and right transfer frames 23, the left and right transfer frames 23 may adopt the same attachment structure of the adjustment bracket 33.

The operation of the above constructed transfer unit of the invention will be described. FIGS. 1 and 2 show a state of the transfer unit when an image is formed (first position), in which the cam part 26*a* of the cam member 26 is fitted into the first cam fitting part 30*b* of the support roller lever 30 by rotation of the operation lever 27. In this state, the transfer roller 13 of the transfer roller lever 29 acts by the energizing power of the spring 32 in the Y1-direction where the transfer roller 13 presses the transfer belt 12. At this time, the second fixing screw 39 is loosened and the adjustment screw 36 is turned thereby to move the adjustment bracket 33 along the boss 23*e*. Then, the adjustment bracket 33 is again fixed by the second fixing screw 39, whereby the transfer pressure by the transfer roller 13 of the transfer roller lever 29 can be set to an appropriate value. Further, under this state, the fitting part 30*a* of the support roller lever 30 is separated from the fitting piece 29*a* of the transfer roller lever 29, and the cam part 26*a* regulates the position of the support roller lever 30. Therefore, the support roller 37, without receiving an influence of the energizing power of the spring 34, is held in the fixed position.

Next, a retreat operation of the transfer unit 7 will be described. FIG. 8 shows a state where the transfer unit is located in an image bearing member detached position (second position). When the operation lever 27 is turned in the left direction from the state shown in FIG. 3, and the cam part 26*a* of the cam member 26 is, as shown in FIG. 8, fitted to the cam fitting part 30*c* of the support roller lever 30, the support roller lever 30 also is rotated by the spring 34 according to the rotation of the cam part 26*a*, and the projection part 30*a* of the support roller lever 30 comes in contact with the fitting piece 29*a* of the transfer roller lever 29, whereby the transfer roller lever 29 also rotates in a Y2-direction. At this time, on the transfer roller 13 side of the transfer roller lever 29, a moment in the reversal rotational direction Y1 (FIG. 3) is produced on the transfer roller 13 side of the transfer roller lever 29 by the spring 32. However, since the energizing power of the spring 34 of the support roller lever 30 is set larger than the energizing power of the spring 32 of the transfer roller lever 29, the transfer roller lever 29 and the support roller lever 30 are fixed in the position shown in FIG. 8. By the movement of these levers, the support roller 37 and the transfer roller 13 also move and stop in the position shown in FIG. 8.

Belt tension is applied to the transfer belt 12 by the tension roller 24 and the spring 24*a*. However, with the movement of the transfer roller 13 and the support roller 37, the transfer belt is also retreated from the image bearing member 3. With the retreat of the transfer belt 12 from the image bearing member 3, a balance of the belt tension at the tension roller 24 is lost, so that the tension roller 24 also moves upward in FIG. 8, and it stops in a state where the balance of the belt tension is caught. Hereby, it is possible to perform taking-out and putting-in of the image bearing member 3 on this side in FIG. 8. In a case that the image bearing member 3 is attached, the user rotates the operation lever 27 in the opposite direction to the before mentioned direction, so that the state at the image forming time shown in FIG. 3 is made.

FIG. 9 shows a state where the transfer unit is located in the carriage position (third position). When the operation lever 27 is further rotated in the left direction from the state shown in FIG. 8, the cam part 26*a* of the cam member 26 is fitted to the lower surface of the fitting piece 29*b* of the transfer roller lever 29, so that the transfer roller lever 29 rotates in the Y2-direction. The support roller lever 30 rotates in the same direction by the rotational moment of the spring 34, and the fitting piece 29*b* of the transfer roller lever 29 is fitted to the fitting piece 23*c* on the transfer frame 23 side, so that the transfer roller lever 29 is locked in the position shown in FIG. 9.

The transfer belt 12 in which the balance of the belt tension is lost by the movement of the support roller 37 and the transfer roller 13 moves further in a direction where it separates from the image bearing member 3. With this movement, the tension roller 24 also moves upward. The carriage position is different from the image bearing member detached position in that a bearing (not shown) for receiving the tension roller 24 comes into contact with the transfer frame 23 and the movement of the tension roller 24 stops. Namely, the energizing power by the spring 24*a* does not act on the transfer belt 12 but the transfer frame 23 receives its energizing power, so that the tension of the transfer belt 12 is released. Further, since the transfer roller 13 is made of a foamed sponge and kept in a non-contact state with the transfer belt 12 in the carriage position, a problem such as permanent strain can be avoided.

For example, though the intermediate transfer unit has been described in the first embodiment, the invention may be applied to a transfer unit which transports a sheet material onto a belt and transfers data directly onto the sheet material.

Figure 10:
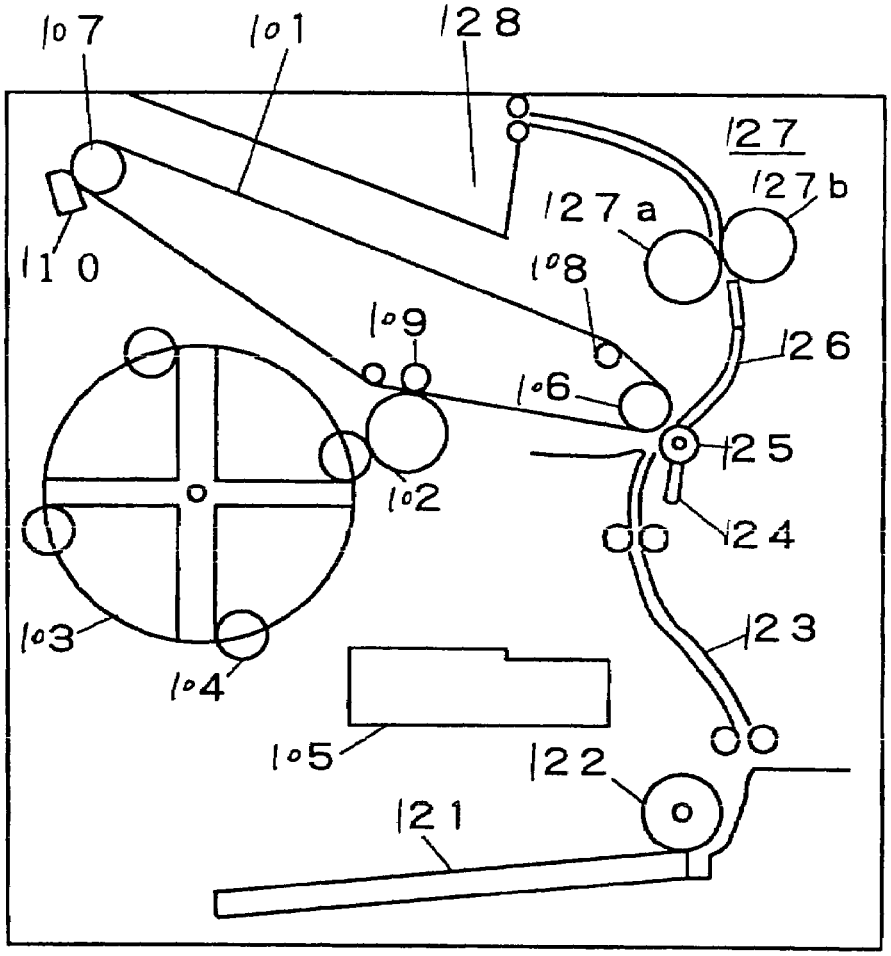
FIG. 10 is a diagram for explaining an example of an image forming apparatus according to a second embodiment.

Next, a second embodiment of the invention will be described below. FIG. 10 is a diagram for explaining an image forming apparatus according to the second embodiment.

A photoconductor 102 is uniformly charged by a charger (not shown) and an electrostatic latent image is formed by image exposure from an exposing unit 105. A rotary type developing device 103 for developing the electrostatic latent image with toner has four color developing units of Yellow (Y), Magenta (M), Cyan (C), and Black (K), a development roller 104 of each unit is brought to a photoconductor position by intermittent rotation of the rotary type developing device, and the development roller 104 is opposed to the photoconductor 102 at its position to perform toner development. An intermediate transfer medium 101 laid onto a drive roller 106, a driven roller 107, a tension roller 108, and a first bias transfer roller 109 comes into contact with and separates from the photoconductor 102 in the position of the first bias transfer roller 109, and a toner image formed on the photoconductor is transferred onto the intermediate transfer medium 101 (first bias transfer), and multilayer transfer of four colors is performed on the intermediate transfer medium.

In a position opposed to the position of the drive roller 106 (used also as a second bias transfer back-up roller), a second bias transfer roller 125 which comes contact with or separates from the intermediate transfer medium 101 by a contact-separation mechanism 124 is provided, and the toner image of four colors is transferred in a lump in this position (second bias transfer). Namely, paper fed out from a paper tray 121 by a feed roller 122 is transported through a paper transporting path 123 to the position of the second bias transfer 125. While the multi layer transfer (first bias transfer) is performed on the intermediate transfer medium, the second bias transfer roller 125 separates from the intermediate transfer medium. However, in second bias transfer, the second bias transfer roller 125 comes into contact with the intermediate transfer medium 101, and applies transfer bias to the intermediate transfer medium 101 thereby to transfer the toner image of four colors onto the paper from the intermediate transfer medium in a lump (second bias transfer). After the second bias transfer, the paper is introduced through a paper guide 126 to a fixing unit 127 comprising a heat roller 127*a* and a pressure roller 127*b*, and discharged onto a discharge tray 128 located on the upper surface of the apparatus.

A cleaning blade 100 comes into contact with or separates from the intermediate transfer medium 101 by a contact-separation mechanism, using the driven roller 107 as a back-up roller, and comes into contact the intermediate transfer medium 101 after the second bias transfer thereby to remove residual toner on the intermediate transfer medium 101. A cleaning member is not limited to the cleaning blade but it may be applied to a brush, a roller or a sheet.

Figure 11:
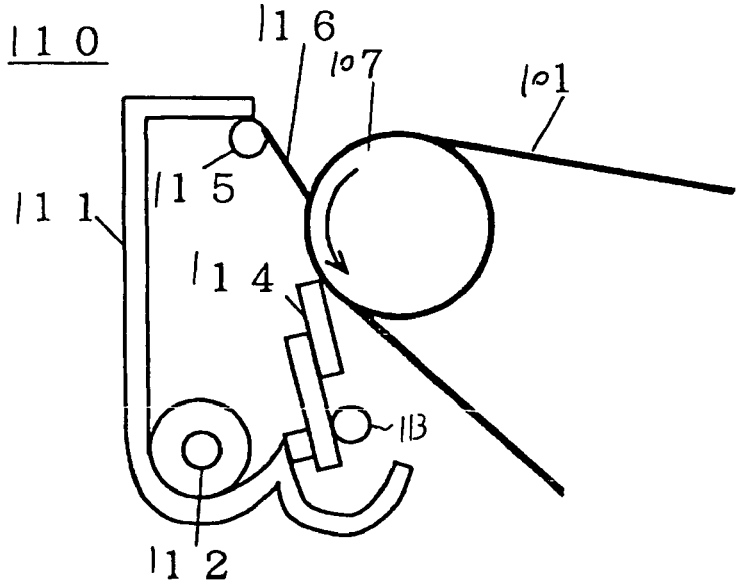
FIG. 11 is a diagram explaining a cleaning unit of the embodiment.

FIG. 11 is a diagram explaining a cleaning unit of the embodiment.

A cleaning unit 110 is provided opposed to the intermediate transfer medium 101 in a position of a back-up roller 107. A screw 112 composed of a spiral member such as a metal spring is provided in the cleaner case 111. Further, a cleaning blade 114 which can contact and separate from the intermediate transfer medium 101 against a blade support shaft 113, and a upper sheet 116 which can contact and separate from the intermediate transfer medium 101 against a upper sheet support shaft 115 are provided on the cleaner case 111 respectively.

After the second bias transfer, the residual toner on the intermediate transfer medium 101 is scraped off by the cleaning blade 114 and housed in the cleaner case 111, and thereafter it is transported by the screw 112 from the cleaner case 111 to a waste toner bottle (not shown). However, abnormal sound is produced by rubbing between the screw 112 which is decentered and a transporting path side surface in a nozzle, and rubbing between the screw 112 which slackens and a transporting path side surface in the cleaner case 111. Therefore, the embodiment adopts the constitution in which a structure of supporting both ends of the screw to prevent generation of the abnormal sound.

Figure 12:
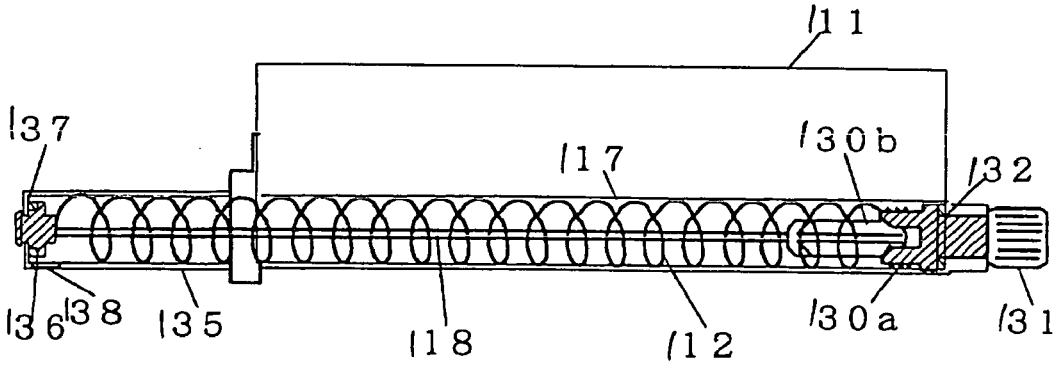
FIG. 12 is a diagram showing an example of prevention of abnormal sound generation.

FIG. 12 is a diagram showing an example of prevention of abnormal sound generation.

At the bottom of the cleaner case 111 serving as a toner housing part, the metal screw 112 is arranged in a transporting path 117. One end of the screw is coupled to a screw drive gear 131 through a coupling 130. The coupling 130 has a coupling member 130*a* coupled to the drive gear side and a coupling member 130*b* coupled to the screw side, and their members are fitted to each other with allowance in an axial direction and in a diameter direction of the screw 112. A ring-shaped seal 32 is provided on the outside of the coupling member 130*a* in order to prevent waste toner leakage.

The screw 112 is provided with a center shaft 118 for determine the whole length of the screw 112 and performing readily positioning on the coupling side in taking out and putting in of the screw. The coupling members 130*b* is loosely fitted to the center shaft 118 and can move axially in relation to the center shaft 118 according to expansion and contraction of the screw.

On the discharge port side of the screw, a nozzle 135 is provided on a side surface of the cleaner case 111, the screw 112 extends from the cleaner case into the nozzle 135. End portion of the screw 112 is attached to an attachment shaft 136. The attachment shaft 136 is supported by a bearing 137 of the nozzle 135 rotatably. Further, a ring-shaped seal is also provided on the outside of the attachment shaft 136 in order to prevent the waste toner leakage. Further, a discharge port 138, from which the waste toner transported from the cleaner case 111 into the nozzle 135 is discharged, is formed at the bottom of the nozzle 135.

Figure 13:
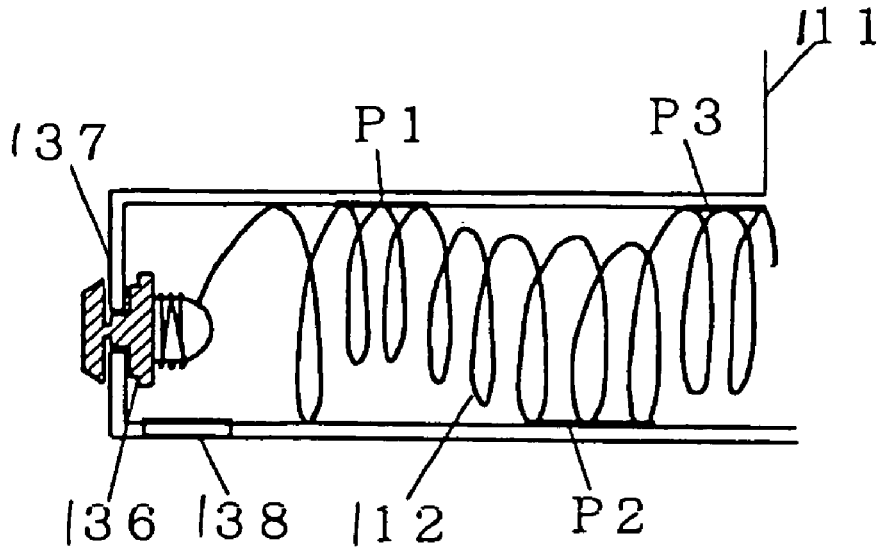
FIG. 13 is a diagram for explaining a condition where a screw on the discharge port side is off-centered.
Figure 14:
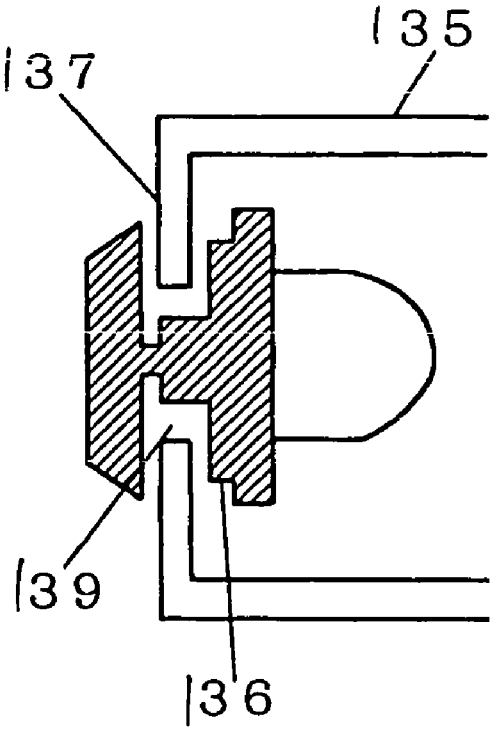
FIG. 14 is a diagram for explaining an abnormal sound generation preventing structure on the screw discharge port side.
Figure 15:
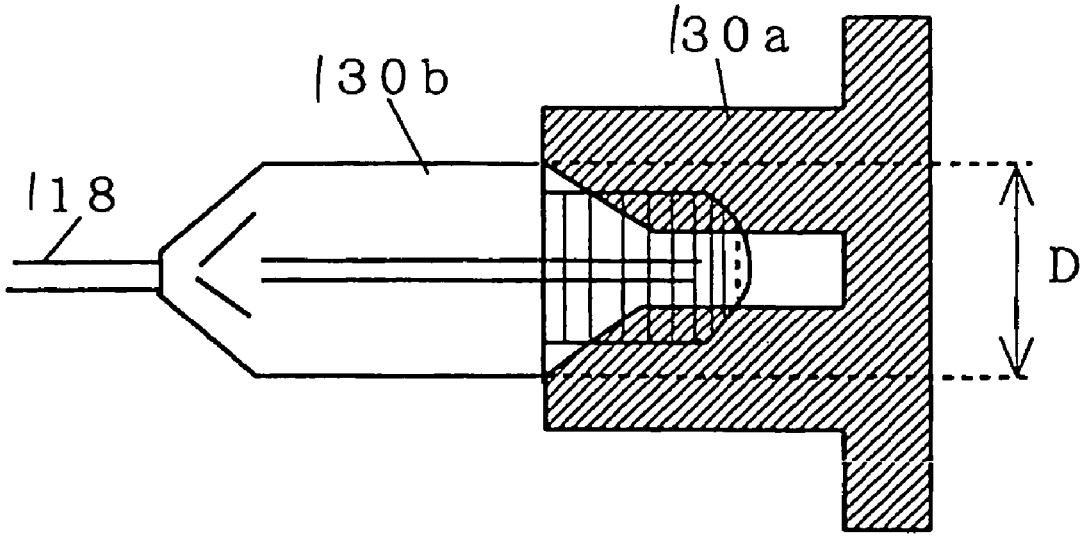
FIG. 15 is a diagram for explaining the abnormal sound generation preventing structure on the drive side.

FIG. 13 is a diagram for explaining a condition where the screw on the discharge port side is decentered, FIG. 14 is a diagram for explaining an abnormal sound generation preventing structure on the screw discharge port side, and FIG. 15 is a diagram for explaining the abnormal sound generation preventing structure on the drive side.

When the screw in the nozzle is decentered, in a case that allowance does not exist in the center position of the screw by the attachment shaft 136 and the bearing 137, portions P1, P2 and P3 at which the screw is strongly pressed against the transporting path side surface in the nozzle are produced as shown in FIG. 13. Therefore, the screw is strongly rubbed at these portions, so that the abnormal sound is generated. Further, due to the friction power generated at the portions P1, P2, and P3, slack is produced in the screw, so that rubbing between the screw and the transporting path side surface causes the abnormal sound in the transporting path of the cleaner case.

Therefore, as shown in FIG. 14, a play 139 is provided between the attachment shaft 136 in the nozzle and the bearing 137 to release the pressure in the diameter direction.

Further, as shown in FIG. 15, the coupling member 130*b* to which the screw end on the drive side is connected has axial allowance in relation to the coupling member 130*a*, whereby the slack is absorbed. Further, a diameter of the coupling member 130*b* which can move axially in relation to the coupling member 130*a* is smaller than a diameter D of an insertion hole of the coupling member 130*a*, whereby allowance can be made in the diameter direction, and the slack of the screw 112 is similarly absorbed. As described above, the pressure in the diameter direction in the nozzle due to decentering of the screw, and the slack of the screw are absorbed, so that the generation of the abnormal sound is prevented.

Next, a third embodiment of the invention will be described below. In the cleaning unit shown in FIG. 11, when the apparatus is violently moved under a state where the waste toner remains in the cleaner case 111, the residual toner remaining inside the cleaner flies up, so that the toner scatters inside the apparatus. Therefore, the third embodiment has adopted the constitution in which a cleaning hole is provided for the cleaner case 111 and the residual toner is sucked through this hole.

Figure 16A:
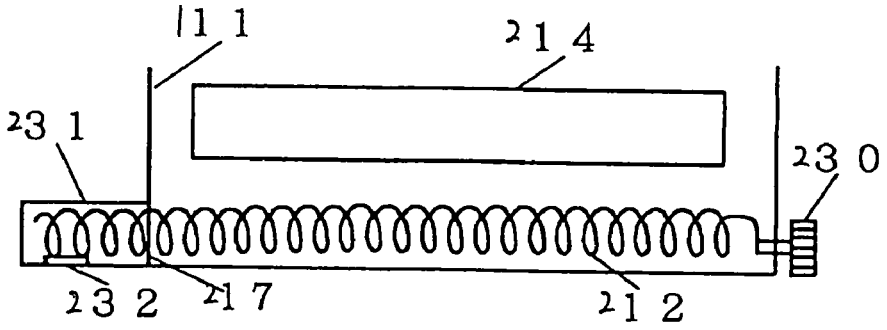
FIGS. 16A to 16C are diagrams showing an example of the cleaning unit in a third embodiment.
Figure 16B:
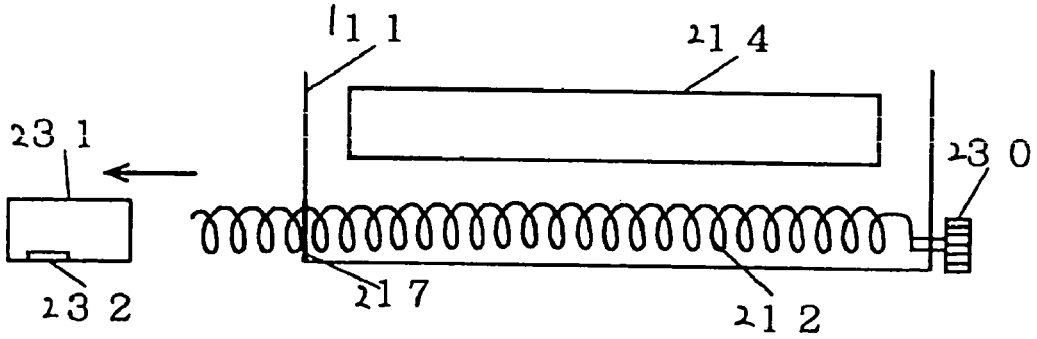
Figure 16C:
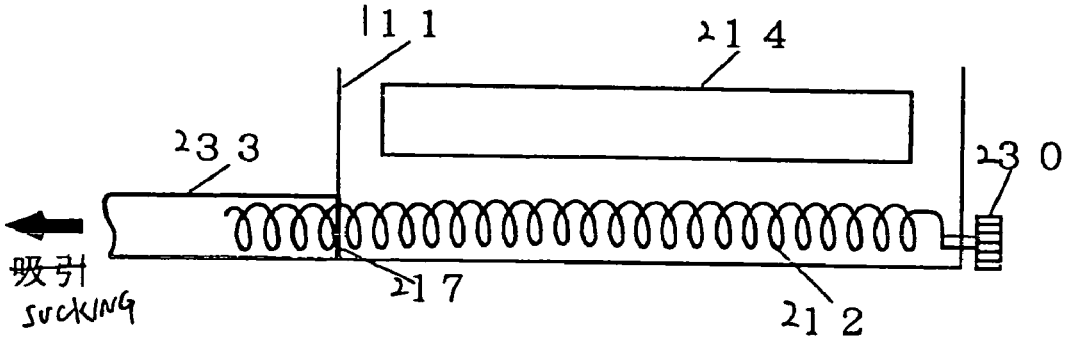

FIGS. 16A to 16C are diagrams showing the cleaning unit of the third embodiment.

As shown in FIG. 16A, at the bottom of the cleaner case 111 serving as a toner housing part, a spiral rotator 212 is arranged below the cleaning blade 214. One end of the rotator 212 is coupled to a spiral rotating gear 230 for driving the spiral rotator. A leading end of the other end is free and extends through a cleaning hole 217 provided on a wall surface of the cleaner case 111 into a waste toner discharge cap 231 used as a plug of the cleaning hole. A waste toner discharge port 232 is formed at the bottom of the waste toner discharge cap 231. The waste toner transported by the spiral rotator 212 which is rotated by the spiral rotating gear 230 is transported through the cleaning hole 217 into the waste toner discharge cap 231. Then, the waste toner drops into a waste toner tank (not shown) from the waste toner discharge port 232.

In order to remove the waste toner remaining in the cleaner case 111, as shown in FIG. 16B, the waste toner discharge cap 231 is taken away. Next, as shown in FIG. 16C, a suction nozzle 233 is put to the cleaning hole 217 and the remaining waste toner is sucked by a pump (not shown). Without detaching the intermediate transfer medium and the cleaner part from the apparatus body, the residual toner inside the cleaner can be removed. Further, since removal of the residual toner is performed on the opposite side to the spiral rotating gear 230 side, there is a merit that the gear 230 is not stained with the toner.

Figure 17A:
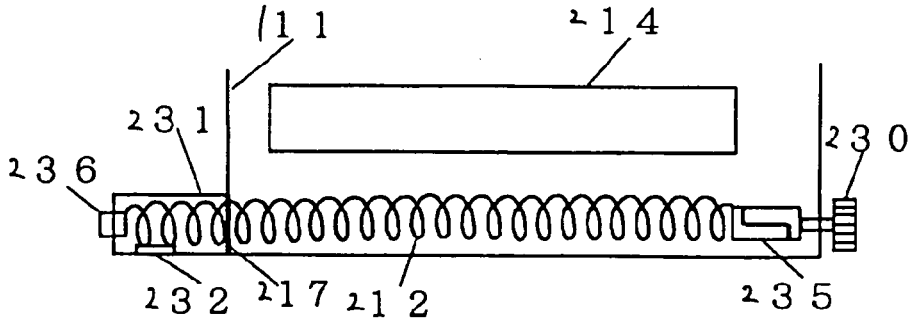
FIGS. 17A to 17C are diagrams showing another example of the cleaning unit in a fourth embodiment.
Figure 17B:
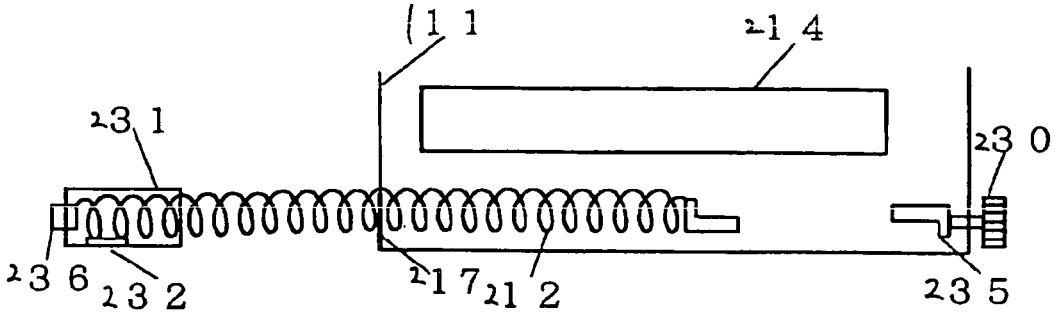
Figure 17C:
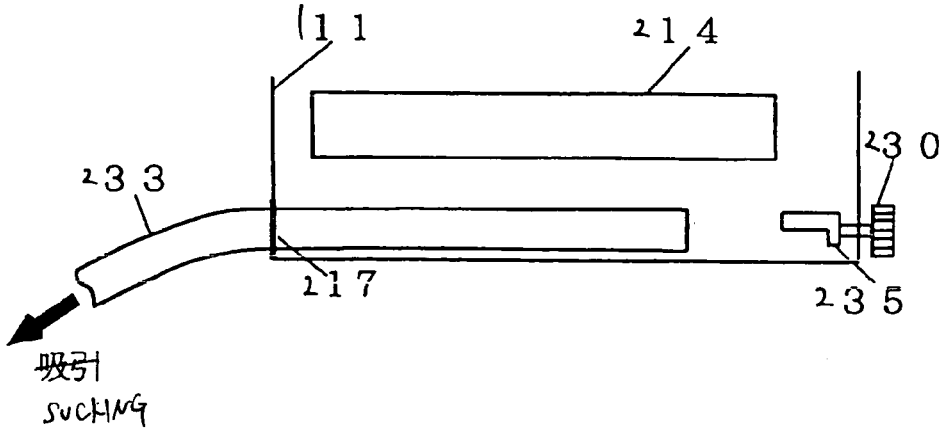

FIGS. 17A to 17C show a cleaning unit according to the fourth embodiment.

In the embodiment, as shown in FIGS. 17A to 17C, one end of the spiral rotator 212 is coupled to the spiral rotating gear 230 through a fittable and separable coupling member 235, and the other end is attached to a spiral rotator attaching shaft 236 which is rotatably provided for the waste toner discharge cap 231. The case shown in FIGS. 17A to 17C is different in this point from the case shown in FIGS. 16A to 16C.

In order to remove the waste toner remaining in the cleaner case 111, as shown in FIG. 17B, disengagement of the spiral rotator 212 from the coupling member 235 is performed and the spiral rotator 212 is pulled out of the case with the waste toner discharge cap 231. Next, as shown in FIG. 17C, the suction nozzle 233 is inserted from the cleaning hole 217 into the case 111, and the waste toner remaining in the case is sucked by the pump. Since the suction nozzle is inserted into the cleaner case and the waste toner is sucked by the pump, without detaching the intermediate transfer medium and the cleaner part from the apparatus body, the residual toner inside the cleaner can be nearly completely removed. Herein, also, since removal of the residual toner is performed on the opposite side to the spiral rotating gear 230 side, there is a merit that the gear 230 is not stained with the toner.

Figure 18A:
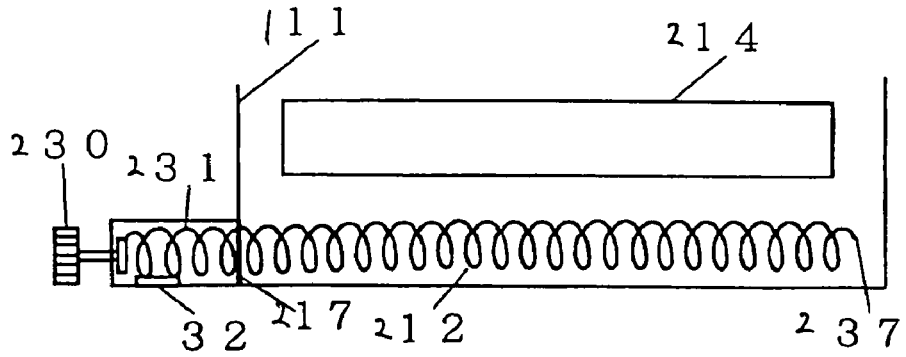
FIGS. 18A to 18C are diagrams showing the cleaning unit according to a fifth embodiment.
Figure 18B:
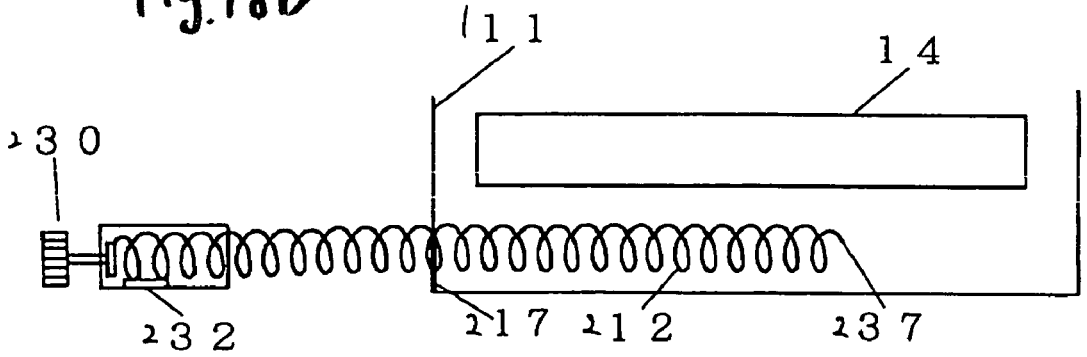
Figure 18C:
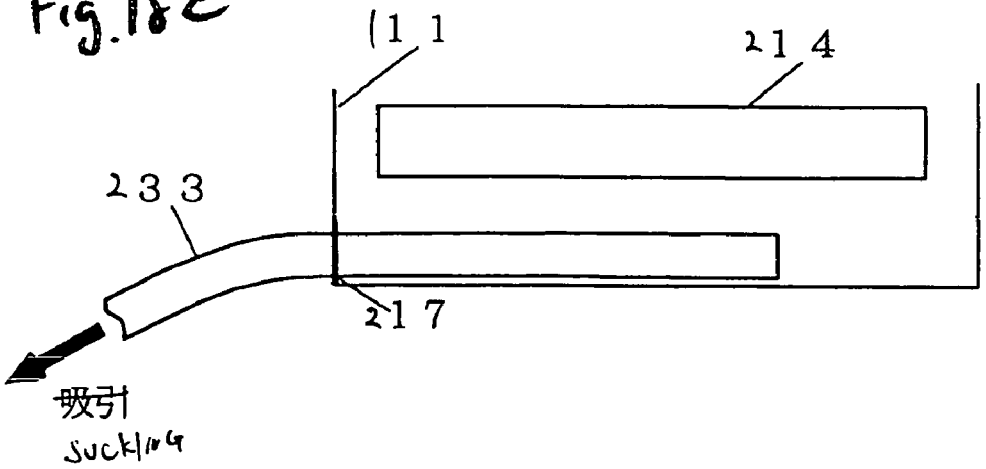

FIGS. 18A to 18C is a diagram showing a cleaning unit according to the fifth embodiment.

In the embodiment, as shown in FIG. 18A, the spiral rotating gear 230 is provided on the waste toner discharge cap 231 side and couples to one end of the spiral rotator 212, and the other end of the spiral rotator 212 is a free end. The case shown in FIGS. 18A to 18C is different in this point from the case shown in FIGS. 17A to 17C.

In order to remove the waste toner remaining in the cleaner case 111, as shown in FIG. 18B, the spiral rotator 212 is pulled out of the case with the spiral rotating gear 230 and the waste toner discharge cap 231. Next, as shown in FIG. 18C, the suction nozzle 233 is inserted from the cleaning hole 217 into the case 111, and the waste toner remaining in the case is sucked by the pump. In the embodiment, the spiral rotating gear 230 is provided on the waste toner discharge cap 231 side and the leading end 237 of the spiral rotator is free. Therefore, an operation of pulling the spiral rotator 112 out of the case is easy, the waste toner is difficult to stay because of the simple inside structure, cleaning is easy, and without detaching the intermediate transfer medium and the cleaner part from the apparatus body, the residual toner inside the cleaner can be nearly completely removed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A transfer device comprising:

a pair of transfer frames;

a belt member;

a pair of transfer roller levers, which are respectively arranged on inner sides of the transfer frames pivotably;

a transfer roller, which is provided between first ends of the transfer roller levers rotatably;

a pair of first urging members, which are respectively provided on second ends of the transfer roller levers to energize the transfer roller toward the belt member;

a pair of transfer pressure controlling members, which are respectively provided on the transfer frames movably to control urging power of the first urging members;

a pair of support roller levers, which are respectively provided on the transfer frames pivotably;

a support roller, which is provided between first ends of the support roller levers, and arranged on an upstream of the transfer roller in a transporting direction of the belt member;

a pair of second urging members, which are respectively provided on the second ends of the support roller levers to energize the support roller levers in a direction in which the support roller separates from the belt member; and a pair of cam members, which are respectively provided on the transfer frames rotatably, wherein the cam members rotate at three positions;

wherein the support roller levers are energized toward the belt member in a first position of the cam members;

wherein the support roller levers are energized toward the transfer roller levers so that both the transfer roller and the support roller are separated from the belt member in a second position of the cam members; and wherein the transfer roller levers are fitted to the transfer frames so that both the transfer roller and the support roller are further separated from the belt member in a third position of the cam members.

2. The transfer device as set forth in claim 1, wherein tension of the belt member is loosed in the third position.

* * * * *